United States Patent [19]

Titterton

[11] Patent Number: 4,497,259

[45] Date of Patent: Feb. 5, 1985

[54] CONVERTIBLE FREIGHT CAR

[76] Inventor: John D. Titterton, 2203 Grey Frirars Ter., Chalfont, Pa. 18914

[21] Appl. No.: 456,539

[22] Filed: Jan. 7, 1983

[51] Int. Cl.[3] ..... B61D 5/02; B65D 88/22; B60P 3/06

[52] U.S. Cl. ..... 105/359; 105/243; 220/85 B; 296/27; 410/54; 410/58

[58] Field of Search ..... 105/243, 355, 358, 359, 105/363; 296/10, 27; 220/85 B; 410/54, 56, 58, 68

[56] References Cited

U.S. PATENT DOCUMENTS

| | | | |
|---|---|---|---|
| 2,773,614 | 12/1956 | Edwards et al. | 105/90 A X |
| 3,037,807 | 6/1962 | Hicks | 105/243 X |
| 3,399,633 | 9/1968 | Herscovitch | 105/215 R X |
| 4,092,051 | 5/1978 | D'Orazio | 105/243 X |
| 4,155,469 | 5/1979 | Cole | 105/243 X |
| 4,241,947 | 12/1980 | Schroder | 105/243 X |

FOREIGN PATENT DOCUMENTS

| | | | |
|---|---|---|---|
| 2308029 | 9/1974 | Fed. Rep. of Germany | 105/359 |

*Primary Examiner*—Randolph Reese
*Attorney, Agent, or Firm*—Jacobson & Johnson

[57] ABSTRACT

A convertible freight car operable as a flatbed car for receiving items such as lumber and the like or as a bulk storage freight car for bulk items such as grain or the like. The freight car is converted from the flatbed car to the bulk storage freight car when the flatbed is elevated upward permitting a plurality of flexible containers attached to the underside of the flatbed to be extended to form containers for receiving bulk goods or liquids.

11 Claims, 15 Drawing Figures

CONVERTIBLE FREIGHT CAR

BACKGROUND OF THE INVENTION

1. Field of the Invention

This invention relates generally to convertible railroad cars and, more specifically, to a rail car that is convertible from a flatbed rail car to a bulk storage freight car through utilization of collapsible containers that are stored beneath the bed of the rail car.

2. Description of the Prior Art

Briefly, the concept of convertible freight hopper cars is known in the art as evidenced by the following patents:

Austill U.S. Pat. No. 3,595,175 shows a hopper box-like or freight car for transferring freight in granular or bulk form with the car including a grate over the opening of the hopper and bulkheads within the car to direct the granular material to the hoppers. The conveyor in the car is enclosed and contains essentially a large compartment for granular freight material.

The Dorey U.S. Pat. No. 2,648,293 shows a convertible railway car having movable floor sections arranged to swing on axes so as to divide the car into various compartments with the car containing bottom discharge doors.

The Kobarynka, et al. U.S. Pat. No. 1,975,955 shows a convertible car with folding doors that permit the car to be used as a grain conveying car or an ordinary box car. The folding doors are placed over the hoppers at the bottom of the car to produce the box car mode and are folded along the side to produce the grain conveying car mode.

The Natali U.S. Pat. No. 1,935,057 shows an invention similar to the Kobarynka, et al. U.S. Pat. No. 1,975,955 with the Natali patent box car having pivotal doors over the hoppers to permit bulk material to be directed through the hopper.

The Pflager U.S. Pat. No. 2,049,617 also shows a hopper car having hinged floor sections which fold over his hoppers.

The Fitch U.S. Pat. No. 2,071,620 shows a flatbed carrier with folding sides for use as either a flatcar or a hopper car.

The Krug U.S. Pat. No. 3,800,712 shows a flatcar having means for mounting standard containers on the top of a flatbed car so that standard containers can be used to transport material.

BRIEF SUMMARY OF THE INVENTION

Briefly, the present invention comprises a convertible rail car having a flatbed that can either be elevated to permit collapsible containers located beneath the flatbed to be filled with bulk material or can be lowered to permit the collapsible containers to be stored in the hopper area so the top of the flatbed can be used as a flatbed car.

DESCRIPTION OF THE PREFERRED EMBODIMENT

Figure 1:
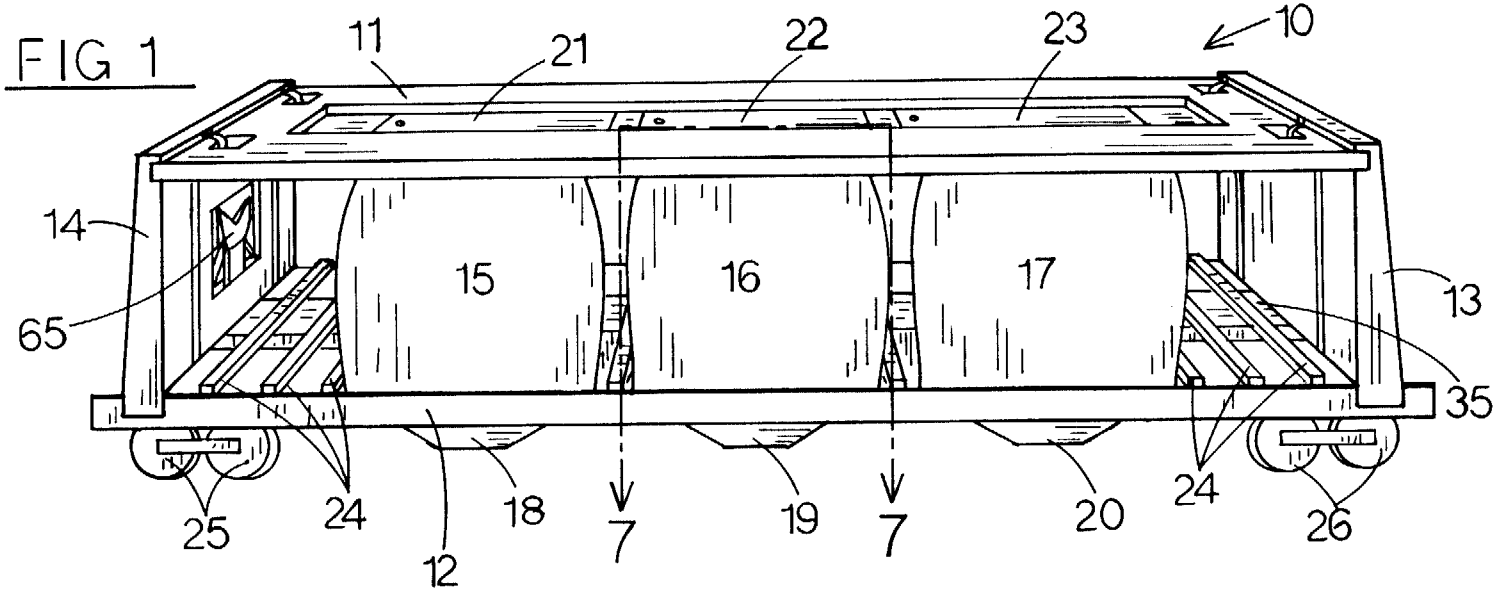
FIG. 1 is a perspective view of my invention in the elevated hopper car position.
Figure 2:
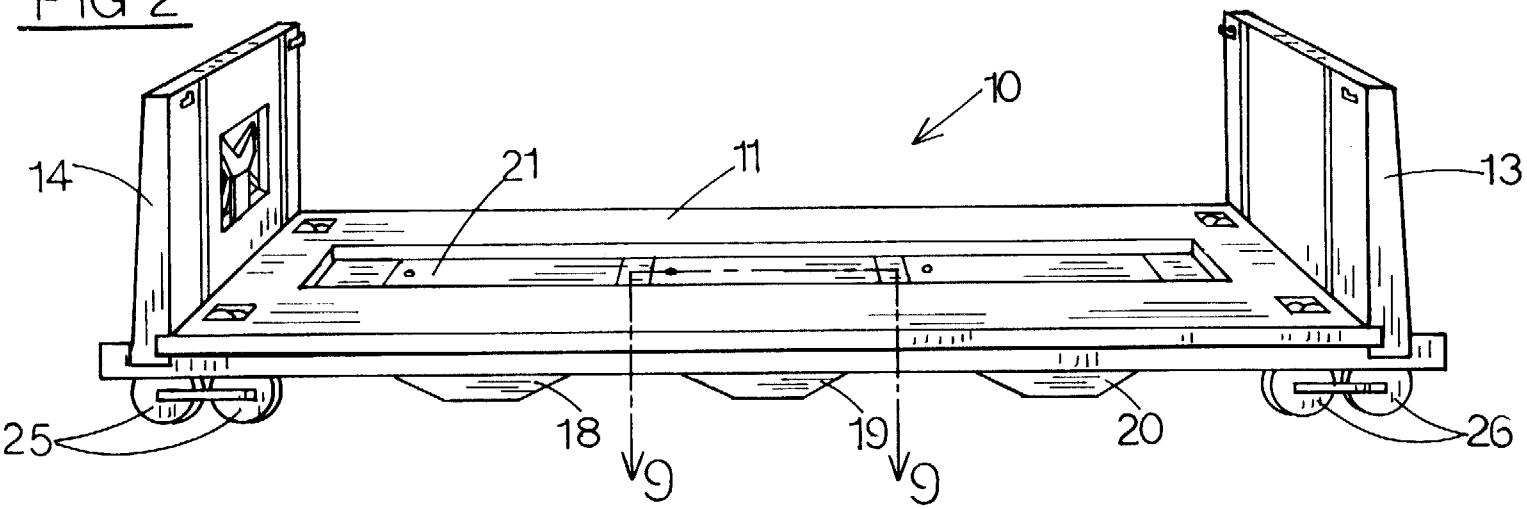
FIG. 2 is a perspective view of my invention in the flat car position.

Referring to FIG. 1, reference numeral 10 generally designates my rail car invention in the form of a covered hopper car while FIG. 2 shows my rail car invention in the form of a bulkhead flatcar. When convertible rail car 10 is in the position shown in FIG. 1 it permits a rail carrier to transport commodities that require a hopper car or a tank car and when convertible rail car 10 is in the position shown in FIG. 2 it permits a rail carrier to transport articles that require either a bulkhead flatcar or a piggyback flatcar.

Generally, convertible car 10 comprises a top flatbed assembly 11, a support frame 12 and a pair of bulkheads 13 and 14 which are located on each end of car 10. Located in the interior of convertible car 10 is a first collapsible container 15, a second collapsible container 16 and a third collapsible container 17. Located below collapsible container 15 is a hopper 18 for directing materials from collapsible container 15 to a receiving bin. Similarly, located below collapsible containers 16 and 17 are, respectively, hoppers 19 and 20 for directing material from containers 16 and 17 to receiving bins. Located in the top of flatbed assembly 11 are a plurality of hatches 21, 22 and 23 which respectively provide access openings for filling containers 15, 16 and 17. In the preferred embodiment hatches 21, 22 and 23 are mounted flush with the top of flatbed assembly 11 so that the hatches do not interfere with loading or stacking of materials on top of bed assembly 11 when car 10 is used as a flatbed carrier.

To load containers 15, 16 and 17 one opens hatches 21, 22 and 23 and closes the bottom gates (not shown) on hopper wells 18, 19 and 20. The containers 15, 16 and 17 can then be filled in the same manner a standard covered hopper car.

While collapsible containers 15, 16 and 17 are shown with hopper bottoms, they may also have liquid tight compartments for holding liquids by placing standard tank car fittings at the top of the collapsible containers and at the bottom of the collapsible containers. The containers can then be loaded with liquid and the car becomes a tank car.

Typically, bulkhead flatcars are known in the art as rail car flatcars with vertical extending stops or bulkheads at either end of the car. The vertical bulkheads at the end of the rail car prevent loads, such as lumber or the like, from spilling off the ends of the rail car when the rail car is subjected to longitudinal forces that occur during starting, stopping, coupling and decoupling. In the flatcar position shown in FIG. 2 collapsible containers 15, 16 and 17 are sandwiched between the underside of flatbed assembly 11 and the hopper wells 18, 19 and 20. Typically, collapsible containers 15, 16 and 17 are made of a flexible and durable material. Material for collapsible containers of this type is well known and are typically manufactured of a fabric and fiber structure to provide a rigid and durable material that can withstand the abuse and repeated collapsing. One such collapsible storage tank which is used for storage of liquids is sold by Uniroyal under the trademark "Sealdtank".

Figure 5:
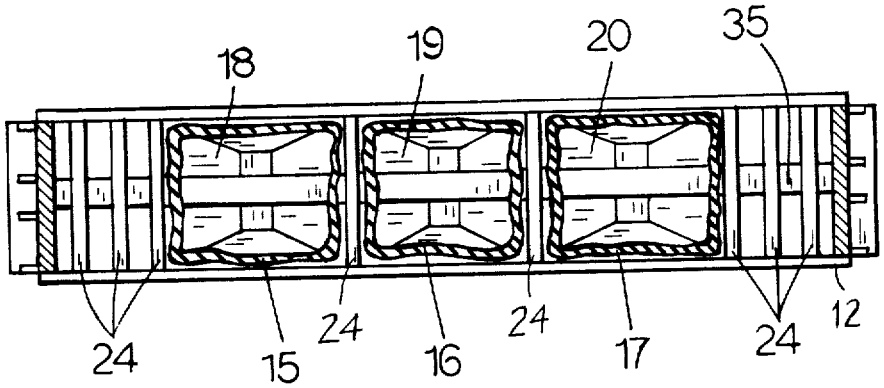
FIG. 5 is a sectional view taken along lines 5—5 of FIG. 4.

To provide the internal structural support for car 10 there is provided an outer support frame 12 and a center sill 35 (FIG. 1 and FIG. 5) that run the length of car 10 with a plurality of cross ribs 24 located on top of sill 35 and support frame 12. Cross ribs 24 provide support for flatbed assembly 11 and its loads when flatbed assembly 11 is in the flatcar position as shown in FIG. 2. FIG. 5 shows that hopper wells 18, 19 and 20 are built into and around support frames 12, which are on opposite sides of car 10, and center sill 35. Hopper wells 18, 19 and 20 are similar to those found on standard hopper cars and include some type of gate (not shown) to permit unloading of material through the hopper wells in the same manner that a conventional hopper car is emptied.

Figure 13:
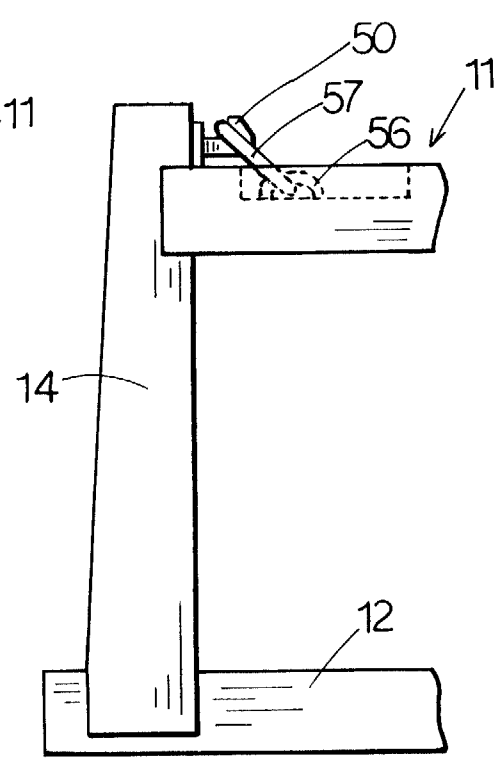
FIG. 13 shows the flatbed supported by the bulkheads.

FIG. 2 shows how flatbed assembly 11 fits snugly over outer support frames 12 and hopper wells 18, 19 and 20 to function as a floor for loads while FIG. 13 shows a mechanism to hold one end of flatbed assembly 11 in an elevated position through means on bulkhead 14. Similarly, the opposite end of flatbed assembly 11 is held in position by identical mechanism (not shown).

Figure 3:
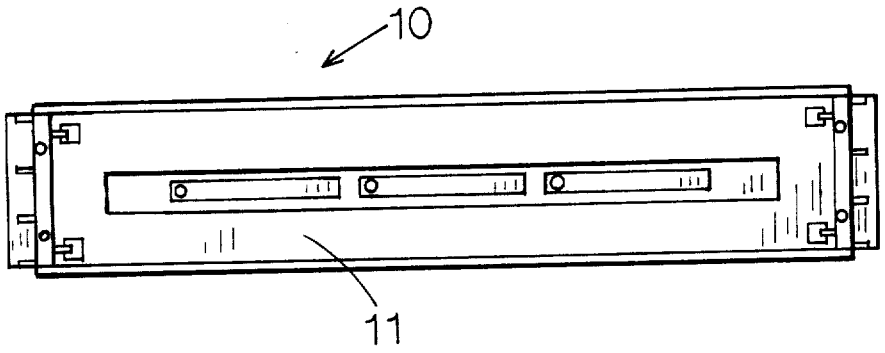
FIG. 3 is a top view of my invention as a hopper car.

To illustrate further details of the interior of car 10 and the collapsible containers in the extended and the collapsed condition reference should be made to FIGS. 3-10. FIG. 3 shows a top view that illustrates how flatbed assembly 11 serves as a top when containers 15, 16 and 17 are in the elevated condition.

Figure 4:
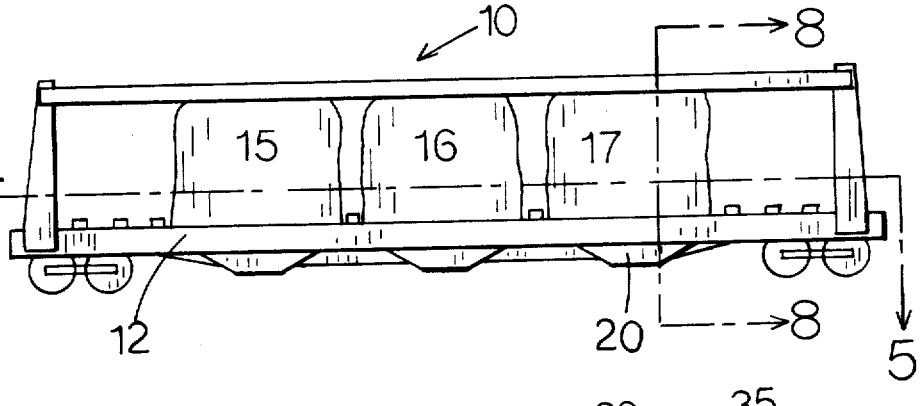
FIG. 4 is a side view of my invention as a hopper car.

Similarly, FIG. 4 shows a side view of car when containers 15, 16 and 17 are in the elevated condition.

FIG. 5 shows a cross sectional view taken through collapsible containers 15, 16 and 17 when they are in the elevated condition to receive bulk materials such as grain, oil or the like. Note, center sill 35 passes through containers 15, 16 and 17 while outside support frames 12 are located outside of the containers. Center sill 35 and support frames 12 coact to provide the structural support for car 10 yet permit material to be discharged through the gates in hopper wells 18, 19 and 20.

Figure 6:
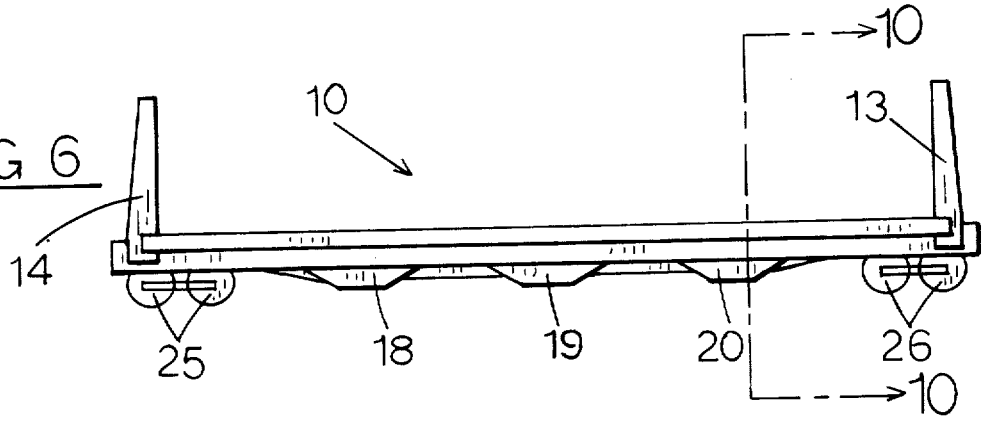
FIG. 6 is a side view of my car as a flat car.
Figure 7:
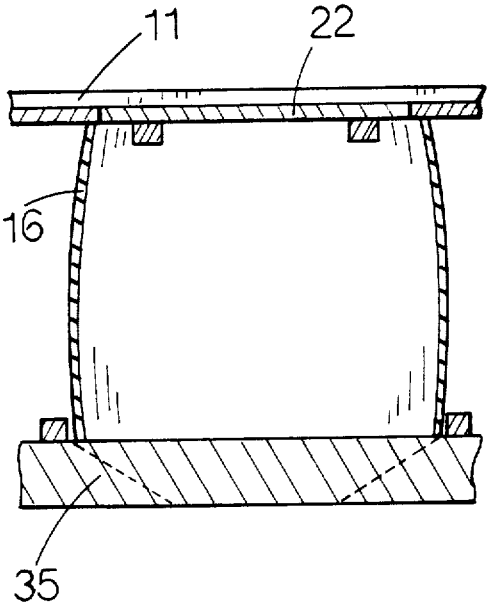
FIG. 7 is a sectional view taken along lines 7—7 of FIG. 1.
Figure 8:
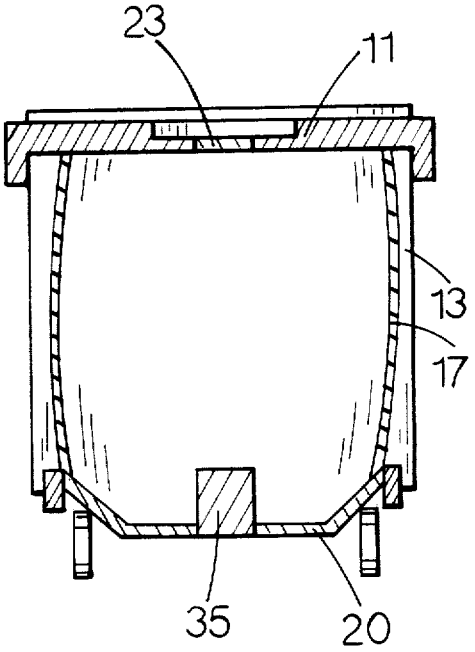
FIG. 8 is a sectional view taken along lines 8—8 of FIG. 4.
Figure 9:
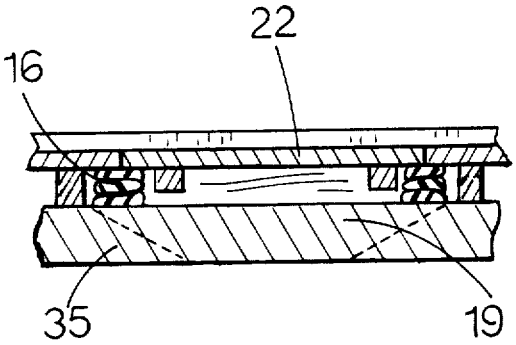
FIG. 9 is a sectional side view of the invention taken along lines 9—9 of FIG. 2.
Figure 10:
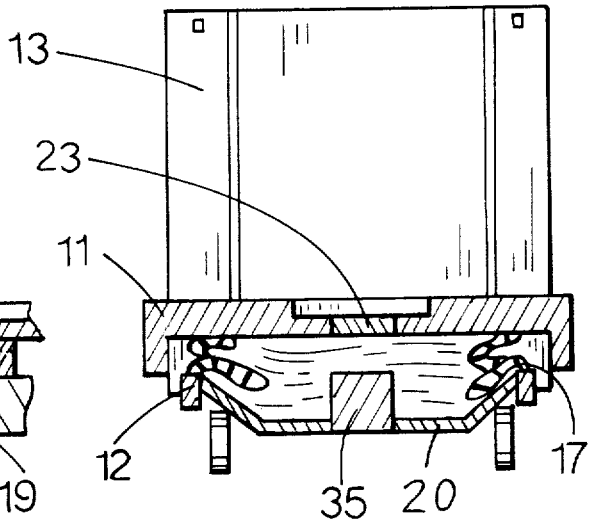
FIG. 10 is a cross sectional view taken along lines 10—10 of FIG. 6.

FIG. 6 is a side view that illustrates the invention in the flatbed condition while FIGS. 9 and 10 illustrate cross sectional views of the collapsible containers in the collapsed or stored condition. FIG. 9 shows collapsible container 16 collapsed beneath the underside of flatbed assembly 11 and the top of sill 35. FIG. 10 shows an end cross sectional view of container 17 in the collapsed condition which also shows how container 17 folds into the space around sill 35 and in hopper 20. In contrast, FIG. 7 shows a side cross sectional view of container 16 in the elevated condition with sill 35 extending therethrough while FIG. 8 shows an end cross sectional view of hopper 20 and collapsible container 16 in the elevated condition with sill 35 extending through container 17.

In order to convert rail car 10 to either of the aforedescribed flatcar mode or hopper car mode, I have provided internal lifting means to raise and lower flatbed 11. The means for converting rail car 10 from a flatcar to a bulkhead carrier is shown in FIG. 11 and FIG. 12 and in the preferred embodiment comprises a pressure-activated system of cylinders and slidable pistons for raising and lowering flatbed assembly 11.

Although flatbed assembly 11 can be raised or lowered by a variety of means in the preferred embodiment, I provide four pressure-activated cylinders 51 which are mounted on each end of bulkheads 13 and 14. Pressurized cylinders 51 are operable to simultaneously lift flatbed assembly 11 and collapsible containers 15, 16 and 17 from their storage position in the respective hopper wells since the tops of collapsible containers 15, 16 and 17 are fastened to the underside of flatbed assembly 11 through conventional means such as bolts and plates that securely clamp the edges of the collapsible container therein (not shown). The steps of lifting and fastening flatbed assembly 11 to the elevated condition are illustrated in FIGS. 11 through 13.

Figure 12:
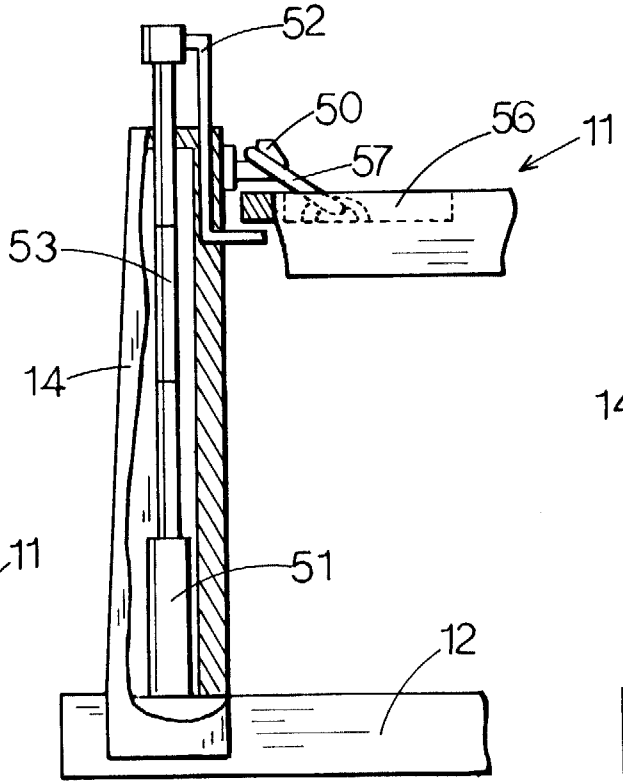
FIG. 12 shows the lifting mechanism in the extended position with the flatbed in the raised position.
Figure 11:
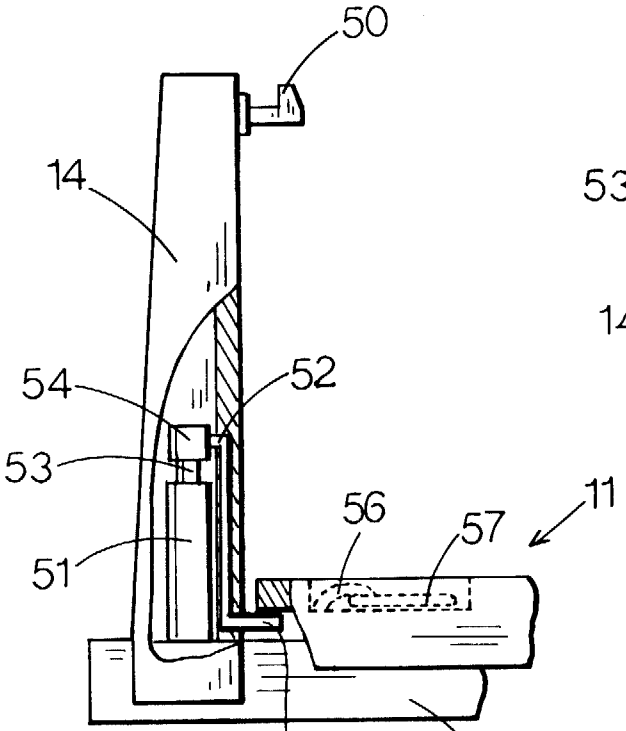
FIG. 11 is a partial side cut-away view of the lifting mechanism for lifting the flatbed.

FIG. 11 shows a partial sectional view of bulkhead 14 that reveals a pressure cylinder 51 in the retracted position while FIG. 12 shows a partial sectional view that reveals pressure cylinder 51 in the extended position. Although four cylinders are used, only one cylinder is shown since the structure and operation of all the cylinders are identical.

One end of pressure cylinder 51 mounts to support frame 12 while bulkhead 14 through means (not shown) holds pressure cylinder 51 in the vertical position. Extending from the top end of pressure cylinder 51 is a telescoping extendible ram 53 and a cap attachment 54 which is connected to generally L-shaped latch mechanism 52. Latch mechanism 52 provides a lip 59 that extends partially under flatbed assembly 11.

In operation cylinders 51 can be hydraulically or pneumatically activated to extend telescoping ram 53 and thus raise flatbed assembly 11 into the position shown in FIG. 12. When flatbed assembly in the raised position a set of link mechanisms 58 (FIG. 15) which are located on the corners of flatbed assembly 11 can be lached to hooks 50 which are located on the top of bulkheads 13 and 14.

Figure 15:
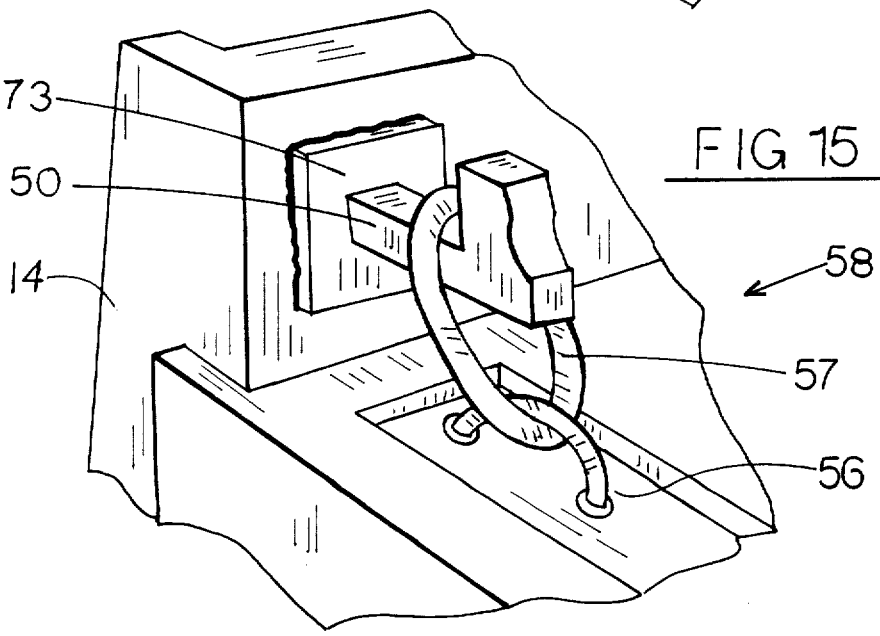
FIG. 15 shows the detail of the mechanism for holding the flatbed in the up position.

FIG. 15 shows the details of hooks 50 and link mechanism 58 for attachment of flatbed assembly 11 to bulkhead 14. Link mechanism 58 comprises a movable link 57 which is mounted in a recess 56 while hook 50 extends from a plate that is fastened to bulkhead 14. Since link 57 is movable, an operator merely slips it over hook 50 to support flatbed assembly 11. Once attached, telescoping ram 53 is lowered leaving links 57 to support flatbed 11.

Figure 14:
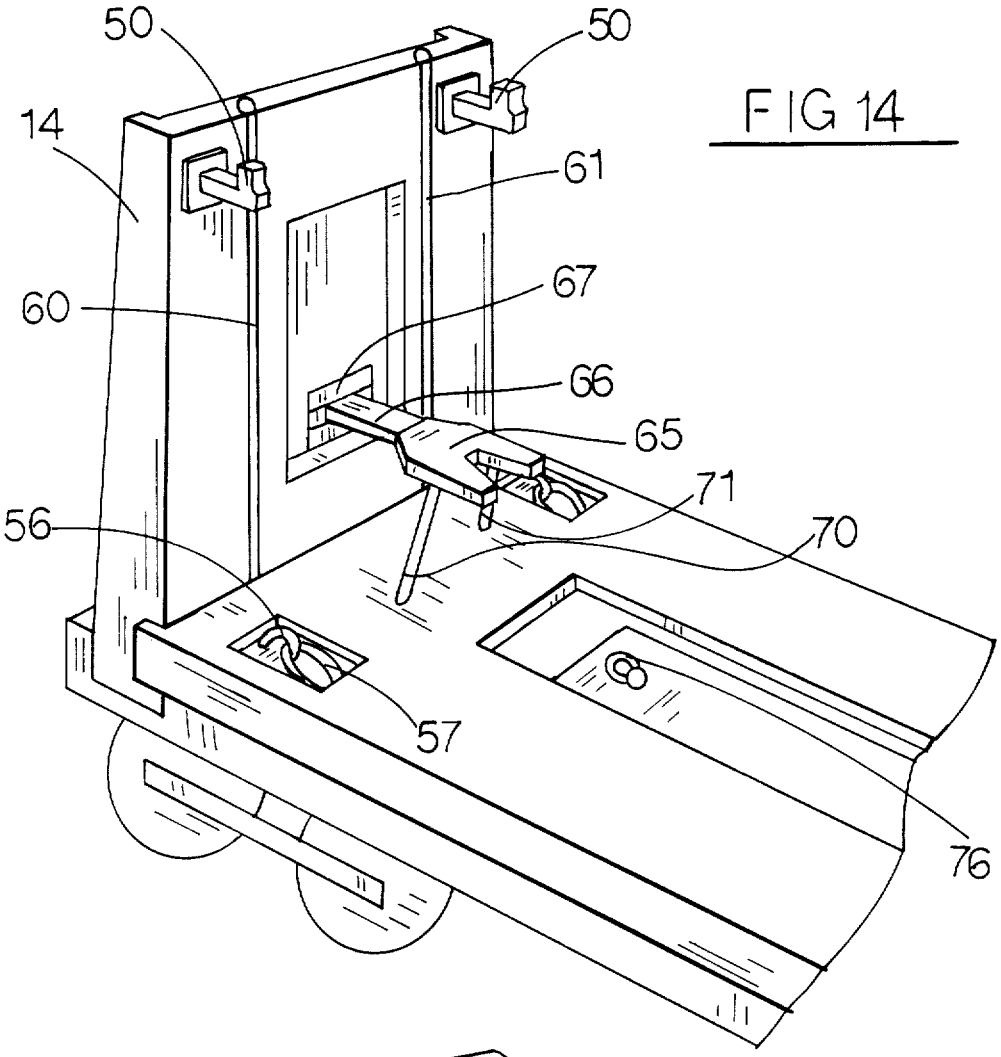
FIG. 14 shows a trailer support system that extends from the bulkhead.

Another use of my invention is its ability to transport highway truck trailers. FIG. 14 shows bulkhead 14 with a standard tractor trailer hitch 65 pivotally mounted on bulkhead 14. Normally, trailer hitch 65 is stored in a vertical position (FIG. 2) and recessed into bulkhead 14 so as not to impede the raising or lowering of floor assembly 11. However, to use car 10 to transport truck trailers one folds trailer hitch 65 about hinge 67 (FIG. 14) until hitch 65 is in a horizontal position parallel to the floor. To hold hinge 65 in this position legs 70 and 71 are fastened to flatbed assembly 11 through means such as pins (not shown). With hitch 65 in the horizontal position one can fasten a standard highway truck trailer thereto to provide piggyback transport of over the road vans. Similarly, to accommodate standard ocean-going containers a container securing device can be incorporated into the floor assembly 11 so as to permit the ocean-going container to be placed on top of floor assembly 11.

I claim:

1. A convertible rail car for use in hauling a variety of material comprising:

a frame;

a first bulkhead located on one end of said frame;

said first bulkhead including a trailer hitch for attachment of a trailer to said convertible rail car;

a second bulkhead located on the opposite end of said frame;

a flatbed assembly having a top and bottom, said flatbed assembly movably mounted on said frame;

said flatbed assembly having at least two hopper wells for discharging material;

at least two collapsible flexible containers, each of said collapsible flexible containers having a top and bottom with said top of said collapsible flexible container connected to the bottom of said flatbed assembly and the bottom of said collapsible flexible container connected to said hopper wells so that said collapsible flexible container can be extended into an elevated condition when said flatbed assembly is raised and can be collapsed into said hopper well when said flatbed assembly is lowered, each of said collapsible flexible containers operable to support a material therein with only restraint of the top and bottom of said flexible container.

2. The invention of claim 1 including means to raise and lower said flatbed assembly to thereby raise and lower said collapsible flexible containers.

3. The invention of claim 2 including means to support said flatbed assembly in an elevated condition.

4. The invention of claim 3 including flush mounted hatches in the top of said flatbed assembly to permit top loading of said collapsible containers.

5. The invention of claim 4 including hoppers connected to said plurality of collapsible containers to permit discharge of material from said collapsible containers.

6. The invention of claim 5 wherein said means for raising said flatbed assembly comprises pressure activatable cylinders.

7. The invention of claim 6 wherein said flatbed assembly includes flush mount link assemblies to permit fastening said flatbed assembly in an elevated condition.

8. The invention of claim 7 wherein said bulkheads include means for attachment to said link assemblies.

9. The invention of claim 1 wherein said frame includes a center sill and outer support frames.

10. The method of converting a flatbed freight car and attaching a trailer thereto, said flatbed freight car having hopper wells and bulkheads at each end comprising the steps of:

elevating a flatbed assembly on the freight car;

extending collapsible flexible containers to form containers for bulk materials; and fastening the elevated flatbed assembly to the bulkheads of the freight car to provide a top support for the collapsible flexible containers;

extending a trailer hitch mounted to one of said bulkheads when the collapsible flexible containers are not in the extended position; and fastening a trailer to said trailer hitch on said bulkhead.

11. The method of claim 10 including the step of unfastening the elevated flatbed assembly and lowering the flatbed assembly while collapsing the containers into the hopper wells to convert the bulk freight car to a flatbed freight car.

* * * * *